US008810559B2

(12) United States Patent
Peng et al.

(10) Patent No.: US 8,810,559 B2
(45) Date of Patent: Aug. 19, 2014

(54) PIXEL STRUCTURE AND DISPLAY SYSTEM UTILIZING THE SAME

(75) Inventors: Du-Zen Peng, Miao-Li County (TW); Tse-Yuan Chen, Miao-Li County (TW); Chih-Chiang Tseng, Miao-Li County (TW); Shou-Cheng Wang, Miao-Li County (TW); Tsung-Yi Su, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 140 days.

(21) Appl. No.: 13/477,674

(22) Filed: May 22, 2012

(65) Prior Publication Data

US 2012/0299896 A1 Nov. 29, 2012

(30) Foreign Application Priority Data

May 26, 2011 (TW) ..... 100118415 A

(51) Int. Cl.
*G09G 3/32* (2006.01)

(52) U.S. Cl.
USPC ..... 345/212; 345/76

(58) Field of Classification Search
CPC ..... G09G 3/30–3/3258; G09G 5/00
USPC ..... 345/76–83, 211–215
See application file for complete search history.

(56) References Cited

U.S. PATENT DOCUMENTS 7,932,880 B2 4/2011 Takahara et al.
2006/0023551 A1* 2/2006 Peng et al. ..... 365/226
2006/0279511 A1 12/2006 Uh et al.
2007/0262931 A1* 11/2007 Peng et al. ..... 345/76
2008/0042939 A1* 2/2008 Yamashita et al. ..... 345/76
2008/0055293 A1 3/2008 Kuo et al.
2008/0088547 A1* 4/2008 Chan et al. ..... 345/76
2011/0069806 A1 3/2011 Liao et al.

FOREIGN PATENT DOCUMENTS

TW 200949797 12/2009
TW 201112202 A 4/2011

OTHER PUBLICATIONS

TW Office Action dated Dec. 12, 2013.
English Abstract translation of TW200949797 (Published Dec. 1, 2009).

* cited by examiner

*Primary Examiner* — Nathan Danielsen
(74) *Attorney, Agent, or Firm* — McClure, Qualey & Rodack, LLP

(57) ABSTRACT

A pixel structure including a first switching transistor, a setting unit, a capacitor, a driving transistor, a second switching transistor and a luminous element is disclosed. The capacitor is coupled between a first and a second node. The first switching transistor transmits a data signal to the first node according to a scan signal. The driving transistor includes a threshold voltage and a gate coupled to the second node. The second switching transistor includes a gate receiving an emitting signal. The luminous element is coupled to the driving transistor and the second switching transistor in series between a first operation voltage and a second operation voltage. The setting unit controls the voltage levels of the first and the second nodes to compensate the threshold voltage of the driving transistor.

11 Claims, 5 Drawing Sheets

PIXEL STRUCTURE AND DISPLAY SYSTEM UTILIZING THE SAME

CROSS REFERENCE TO RELATED APPLICATIONS

This application claims priority of Taiwan Patent Application No. 100118415, filed on May 26, 2011, the entirety of which is incorporated by reference herein.

BACKGROUND OF THE INVENTION

1. Field of the Invention

The invention relates to a pixel structure, and more particularly to a pixel structure of a display system.

2. Description of the Related Art

Because cathode ray tubes (CRTs) are inexpensive and provide high definition, they are utilized extensively in televisions and computers. With technological development, new flat-panel displays have continually been developed in recent years. The flat-panel displays are widely used as they possess the favorable advantages of having a thin profile and light weight.

Generally, each flat-panel display comprises a display panel comprising various pixels. Each pixel comprises a driving transistor and a luminous element. The driving transistor generates a driving current according to an image signal. The luminous element displays correspond to brightness according to the driving current.

However, the driving transistors in the different pixels may comprise different threshold voltages because the driving transistors are affected by the manufacturing thereof. When some pixels receive the same image signal, the corresponding driving transistors may generate different driving currents such that corresponding luminous elements display different brightness.

BRIEF SUMMARY OF THE INVENTION

In accordance with an embodiment, a pixel structure comprises a first switching transistor, a setting unit, a capacitor, a driving transistor, a second switching transistor and a luminous element. The first switching transistor transmits a data signal to a first node according to a scan signal. The setting unit controls the voltage level of the first node and the voltage level of a second node according to the scan signal and a discharging signal. The capacitor is coupled between the first and the second nodes. The driving transistor comprises a first threshold voltage and a gate coupled to the second node. The second switching transistor comprises a gate receiving an emitting signal. The luminous element is coupled to the driving transistor and the second switching transistor in series between a first operation voltage and a second operation voltage. During a first period, the setting unit controls the voltage level of the first node to equal to a first reference voltage and controls the voltage level of the second node to equal to a second reference voltage, and the first reference voltage exceeds the second reference voltage. During a second period, the first switching transistor transmits the first data signal to the first node, and the setting unit controls the voltage level of the second node to equal to a difference between the first operation voltage and the first threshold voltage. During a third period, the setting unit controls the voltage level of the first node to equal to the first reference voltage and floats the second node.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
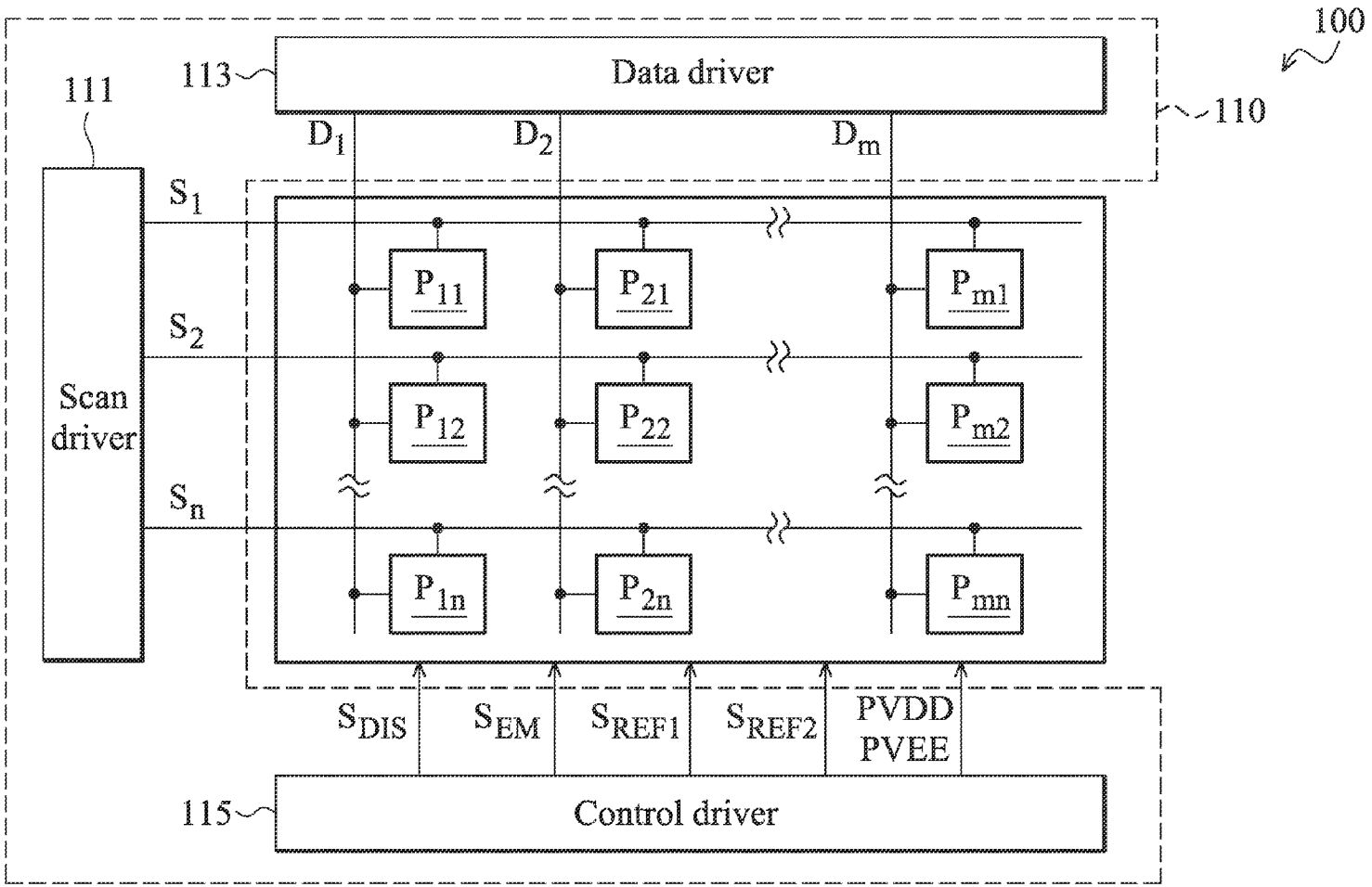
FIG. 1 is a schematic diagram of an exemplary embodiment of a display system.

FIG. 1 is a schematic diagram of an exemplary embodiment of a display system. The display system 100 comprises a driving module 110 and pixels $P_{11}$~$P_{mn}$. The driving module 110 provides signals to the pixels $P_{11}$~$P_{mn}$. In this embodiment, the driving module 110 comprises a scan driver 111, a data driver 113 and a control driver 115.

The scan driver 111 provides scan signals $S_1$~$S_n$ to the pixels $P_{11}$~$P_{mn}$. The data driver 113 provides data signals $D_1$~$D_m$ to the pixels $P_{11}$~$P_{mn}$. The pixels $P_{11}$~$P_{mn}$ receive the data signals $D_1$~$D_m$ according to the scan signals $S_1$~$S_n$ and display corresponding brightness according to the data signals $D_1$~$D_m$. The control driver 115 provides a discharging signal $S_{DIS}$, an emitting signal $S_{EM}$, reference voltages $S_{REF1}$, $S_{REF2}$, and operation voltages PVDD and PVEE to the pixels $P_{11}$~$P_{mn}$ such that driving transistors of the pixels $P_{11}$~$P_{mn}$ generate driving currents and each driving current is not affected by the threshold voltage of the corresponding driving transistor.

Figure 2A:
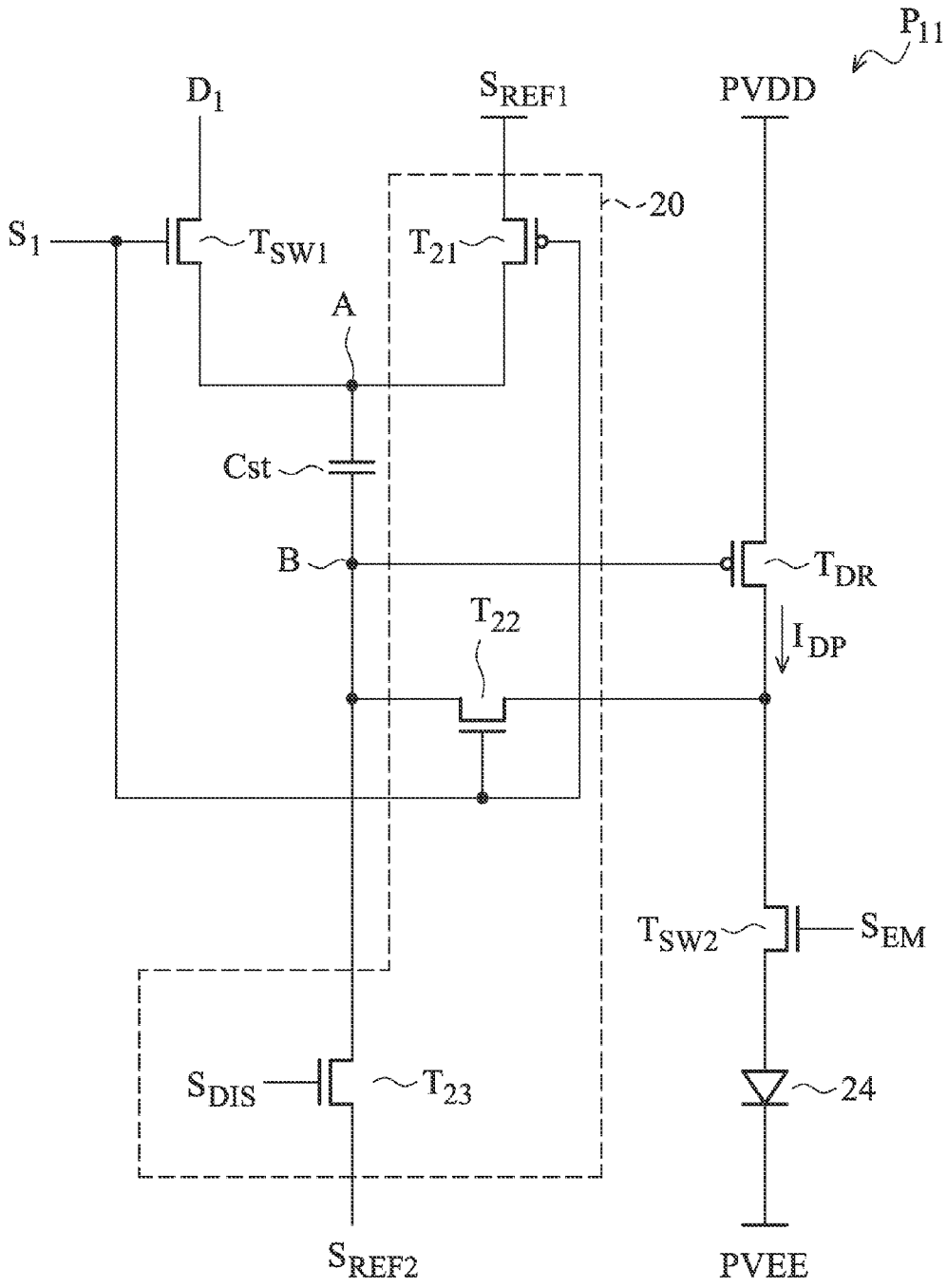
FIGS. 2A, 3 and 4 are schematic diagrams of other exemplary embodiments of a pixel structure.

FIG. 2A is a schematic diagram of an exemplary embodiment of a pixel structure. Since the circuits of the pixels $P_{11}$~$P_{mn}$ are the same, the pixel $P_{11}$ is given as an example. As shown in FIG. 2A, the pixel $P_{11}$ comprises switching transistors $T_{SW1}$, $T_{SW2}$, a setting unit 20, a capacitor Cst, a driving transistor $T_{DR}$ and a luminous element 24.

The switching transistor $T_{SW1}$ transmits the data signal $D_1$ to a node A according to the scan signal $S_1$. The invention does not limit the type of the switching transistor $T_{SW1}$. In this embodiment, the switching transistor $T_{SW1}$ is an N-type transistor. The N-type transistor comprises a gate receiving the scan signal $S_1$, a drain receiving the data signal $D_1$ and a source coupled to the node A.

The capacitor Cst is coupled between the nodes A and B. The driving transistor $T_{DR}$ comprises a threshold voltage ($Vt_{(DR)}$). The invention does not limit the type of the driving transistor $T_{DR}$. In this embodiment, the driving transistor $T_{DR}$ is a P-type transistor. The P-type transistor comprises a gate coupled to the node B, a source receiving the operation voltage PVDD and a drain coupled to the setting unit 20 and the switching transistor $T_{SW2}$.

The switching transistor $T_{SW2}$ transmits a driving current $I_{DP}$ generated by the driving transistor $T_{DR}$ to the luminous element 24 according to the emitting signal $S_{EM}$. The invention does not limit the type of the switching transistor $T_{SW2}$. In this embodiment, the switching transistor $T_{SW2}$ is an N-type transistor. The N-type transistor comprises a gate receiving the emitting signal $S_{EM}$, a drain coupled to the driving transistor $T_{DR}$ and a source coupled to the luminous element 24.

The luminous element 24 is coupled to the driving transistor $T_{DR}$ and the switching transistor $T_{SW2}$ in series between the operation voltages PVDD and PVEE. The invention does not limit the kind of the luminous element 24. Any element, which is lighted according to a driving current, can serve as the luminous element 24. In one embodiment, the luminous element 24 is an organic light emitted diode (OLED).

The setting unit 20 and the switching transistor $T_{SW1}$ controls the voltage levels of the nodes A and B according to the scan signal $S_1$ and the discharging signal $S_{DIS}$. The invention does not limit the circuit of the setting unit 20. Any circuit, which can achieve the setting functions of the setting unit 20, can serve as the setting unit 20.

During a first period, the setting unit 20 controls the voltage level of the node A to equal to the reference voltage $S_{REF1}$ and controls the voltage level of the node B to equal to the reference voltage $S_{REF2}$. The reference voltage $S_{REF1}$ is different from the reference voltage $S_{REF2}$. In this embodiment, the reference voltage $S_{REF1}$ exceeds the reference voltage $S_{REF2}$. In another embodiment, the reference voltage $S_{REF1}$ is a positive value and the reference voltage $S_{REF2}$ is a negative value. In other embodiments, a difference between the reference voltages $S_{REF1}$ and $S_{REF2}$ exceeds the threshold voltage of the driving transistor $T_{DR}$.

During a second period, the switching transistor $T_{SW1}$ transmits the data signal $D_1$ to the node A. During this period, the setting unit 20 controls the voltage level of the node B to equal to a difference between the operation voltage PVDD and the threshold voltage $Vt_{(DR)}$ of the driving transistor $T_{DR}$.

Since the voltage level of the node A is different from the voltage level of the node B during the first period, when the voltage level of the node A is equal to the data signal $D_1$ during the second period, the voltage level of the node B is equal to the difference between the operation voltage PVDD and the threshold voltage $Vt_{(DR)}$ of the driving transistor $T_{DR}$ during the second period.

During a third period, the setting unit 20 controls the nodes A and B such that the voltage level of the node A is equal to the reference voltage $S_{REF1}$ and the node B is in a floating state. At this period, the voltage level $V_B$ of the node B is equal to $PVDD-Vt_{(DR)}-(D_1-S_{REF1})$.

During the third period, the driving transistor $T_{DR}$ generates the driving current $I_{DP}$ according to the following equation (1):

$$I_{DP}=K_P*(Vsg-Vt_{(DR)})^2 \quad \text{Equation (1).}$$

wherein $K_P$ is a parameter of the driving transistor $T_{DR}$ and is a pre-determined value, Vsg is a difference between the source of the driving transistor $T_{DR}$ and the gate of the driving transistor $T_{DR}$, and $Vt_{(DR)}$ is the threshold voltage of the driving transistor $T_{DR}$.

If we substitute the difference between the source and the gate of the driving transistor $T_{DR}$ with equation (1), the substituted result is expressed by the following equation (2):

$$I_{DP}=K_P*\{PVDD-[PVDD-Vt_{(DR)}-(D_1-S_{REF1})]-Vt_{(DR)}\}^2 \quad \text{Equation (2).}$$

If we simplify equation (2):

$$I_{DP}=K_P*(D_1-S_{REF1})^2 \quad \text{Equation (3).}$$

According to the equation (3), the driving current $I_{DP}$ is not affected by the threshold voltage $Vt_{(DR)}$ of the driving transistor $T_{DR}$. Thus, if the driving transistors of some pixels comprise the different threshold voltages and the some pixels receive the same data signals, the driving transistors of the some pixels generate the same driving currents.

The invention does not limit the circuit structure of the setting unit 20. Any circuit, which can achieve the above functions, can serve as the setting unit 20. In this embodiment, the setting unit 20 comprises setting transistors $T_{21}$~$T_{23}$.

The setting transistor $T_{21}$ transmits the reference voltage $S_{REF1}$ to the node A according to the scan signal $S_1$. The setting transistor $T_{22}$ controls the driving transistor $T_{DR}$ such that the gate of the driving transistor $T_{DR}$ is connected to the drain of the driving transistor $T_{DR}$. Thus, the driving transistor $T_{DR}$ forms a diode connection. The setting transistor $T_{23}$ transmits the reference voltage $S_{REF2}$ to the node B according to the discharging signal $S_{DIS}$.

The invention does not limit the type of the setting transistors $T_{21}$~$T_{23}$. In this embodiment, the setting transistor $T_{21}$ is a P-type transistor and the setting transistors $T_{22}$ and $T_{23}$ are N-type transistors, however, the invention is not limited thereto. In other embodiments, the setting transistors $T_{21}$~$T_{23}$ are P-type transistors or are N-type transistors or a portion of the setting transistors $T_{21}$~$T_{23}$ are N-type transistors or P-type transistors. The method for transformation between P-type and N-type transistors is well known to those skilled in the field, thus, description thereof is omitted for brevity. FIG. 2A is given as an example to describe the connection of the setting transistors $T_{21}$~$T_{23}$.

As shown in FIG. 2A, the setting transistor $T_{21}$ comprises a gate receiving the scan signal $S_1$, a source receiving the reference voltage $S_{REF1}$ and a drain coupled to the node A. The setting transistor $T_{22}$ comprises a gate receiving the scan signal $S_1$, a drain coupled to the node B and a source coupled to the drain of the driving transistor $T_{DR}$. The setting transistor $T_{23}$ comprises a gate receiving the discharging signal $S_{DIS}$, a drain receiving the reference voltage $S_{REF2}$ and a source coupled to the node B.

Figure 2B:
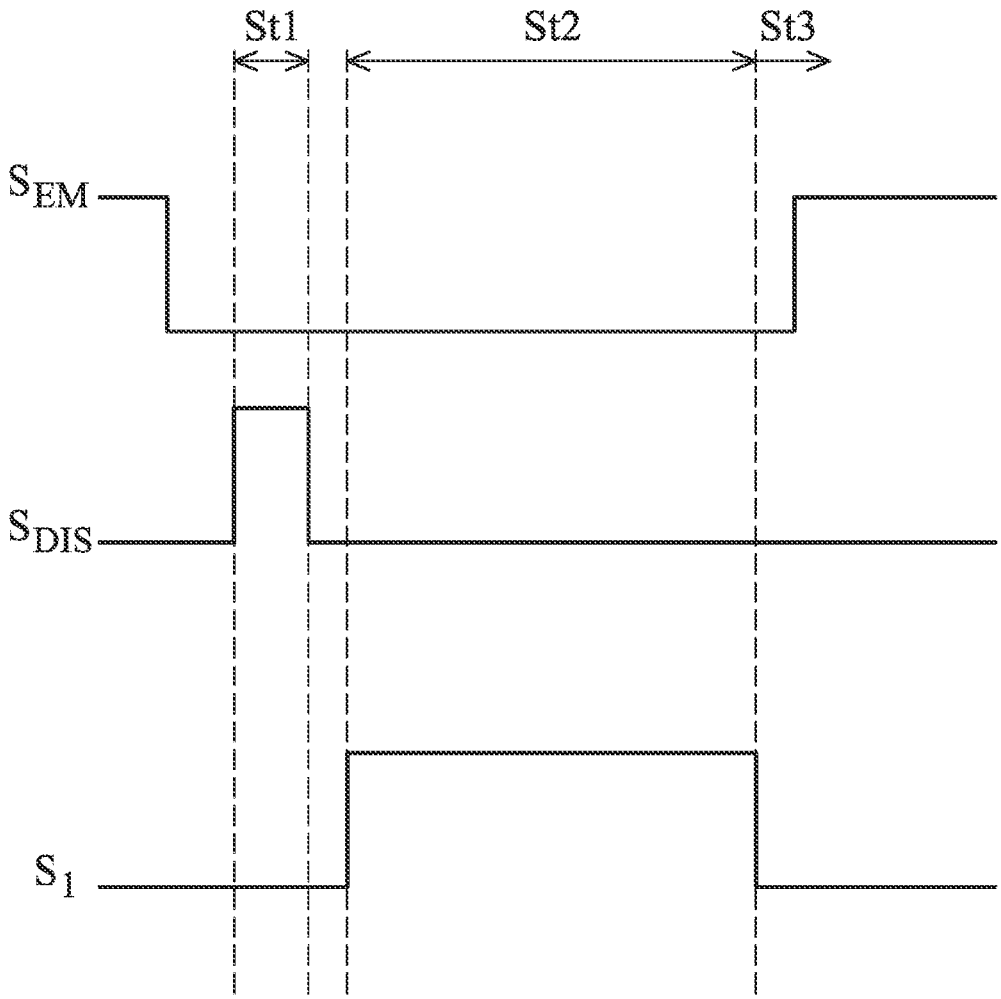
FIG. 2B is a timing diagram of an exemplary embodiment of the invention.

FIG. 2B is a timing diagram of an exemplary embodiment of the invention. During the first period St1, the scan signal $S_1$ is at a low level to turn on the setting transistor $T_{21}$. Thus, the voltage level of the node A is equal to the reference voltage $S_{REF1}$. At this period, the discharging signal $S_{DIS}$ is at a high level such that the setting transistor $T_{23}$ is turned on. Thus, the voltage level of the node B is equal to the reference voltage $S_{REF2}$.

During the second period St2, the scan signal $S_1$ is at the high level to turn on the switching transistor $T_{SW1}$ and the setting transistor $T_{22}$. Thus, the voltage level of the node A is equal to the data signal $D_1$, and the gate of the driving transistor $T_{DR}$ is connected to the drain of the driving transistor $T_{DR}$. Since the driving transistor $T_{DR}$ forms a diode connection, the voltage level of the node B is the difference between the operation voltage PVDD and the threshold voltage $Vt_{(DR)}$ of the driving transistor $T_{DR}$.

During the third period St3, the scan signal $S_1$ is at the low level to again turn on the setting transistor $T_{21}$. Thus, the voltage level of the node A is equal to the reference voltage $S_{REF1}$. Since the scan signal is at the low level, the setting transistors $T_{22}$ and $T_{23}$ are turned off. In this embodiment, the voltage level of the node B is equal to $PVDD-Vt_{(DR)}-(D_1-S_{REF1})$. When the emitting signal $S_{EM}$ is at the high level, the switching transistor $T_{SW2}$ is turned on to transmit the driving current $I_{DP}$ to the luminous element 24. The driving current $I_{DP}$ is expressed by the equation (3).

During the first period St1, the voltage level of the node B is less than the voltage level of the node A. Thus, when the voltage level of the node A is equal to the data signal $D_1$ (during the second period St2), the driving transistor $T_{DR}$ and the setting transistor $T_{22}$ normally operates due to the coupling effect of the capacitor Cst. In other words, the voltage level of the node B is equal to PVDD−$Vt_{(DR)}$. Thus, the driving transistor $T_{DR}$ forms a diode connection. In addition, the gray level of the data signal $D_1$ can equal to the operation voltage PVDD. Since the maximum gray level of the data signal is not limited in PVDD−$Vt_{(DR)}$, the range of the gray level is increased. In other words, when the operation voltage PVDD is reduced, the power consumption can be reduced and the range of the gray level is not affected.

Figure 3:
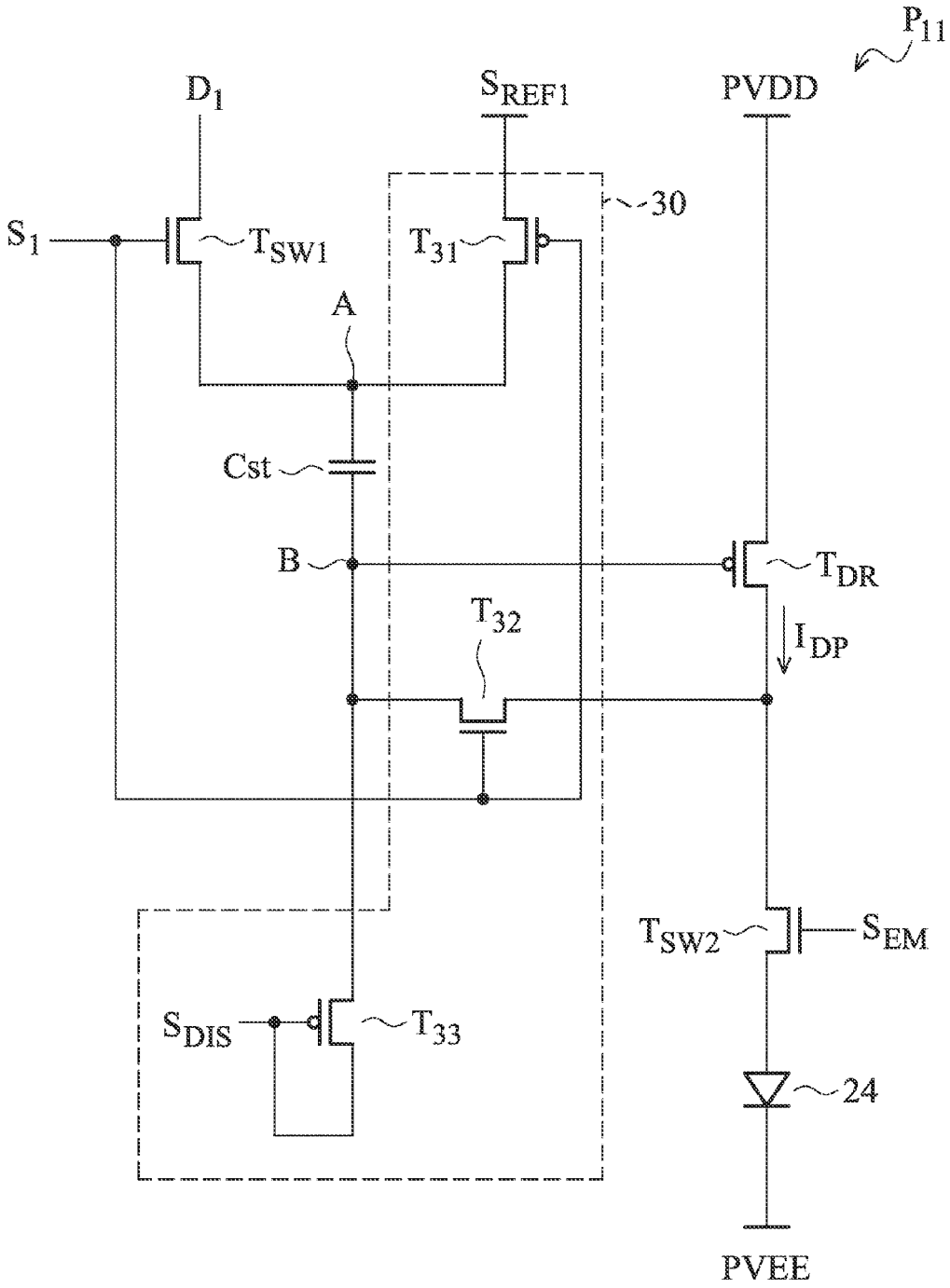

FIG. 3 is a schematic diagram of another exemplary embodiment of the pixel structure. FIG. 3 is similar to FIG. 2A with the exception that the setting transistor $T_{33}$ is a P-type transistor. Since the connection between the setting transistors $T_{31}$ and $T_{32}$ is the same as the connection between the setting transistors $T_{21}$ and $T_{22}$, description is omitted for brevity.

In this embodiment, the setting transistor $T_{33}$ is a diode connection. The setting transistor $T_{33}$ comprises a gate receiving the discharging signal $S_{ms}$, a drain coupled to the node B and a source receiving the discharging signal $S_{DIS}$. When the discharging signal $S_{DIS}$ is at the low level, the voltage level of the node B is equal to the sum of the operation voltage PVEE and the threshold voltage of the setting transistor $T_{33}$. In one embodiment, the discharging signal $S_{DIS}$ is equal to the operation voltage PVEE.

Figure 4:
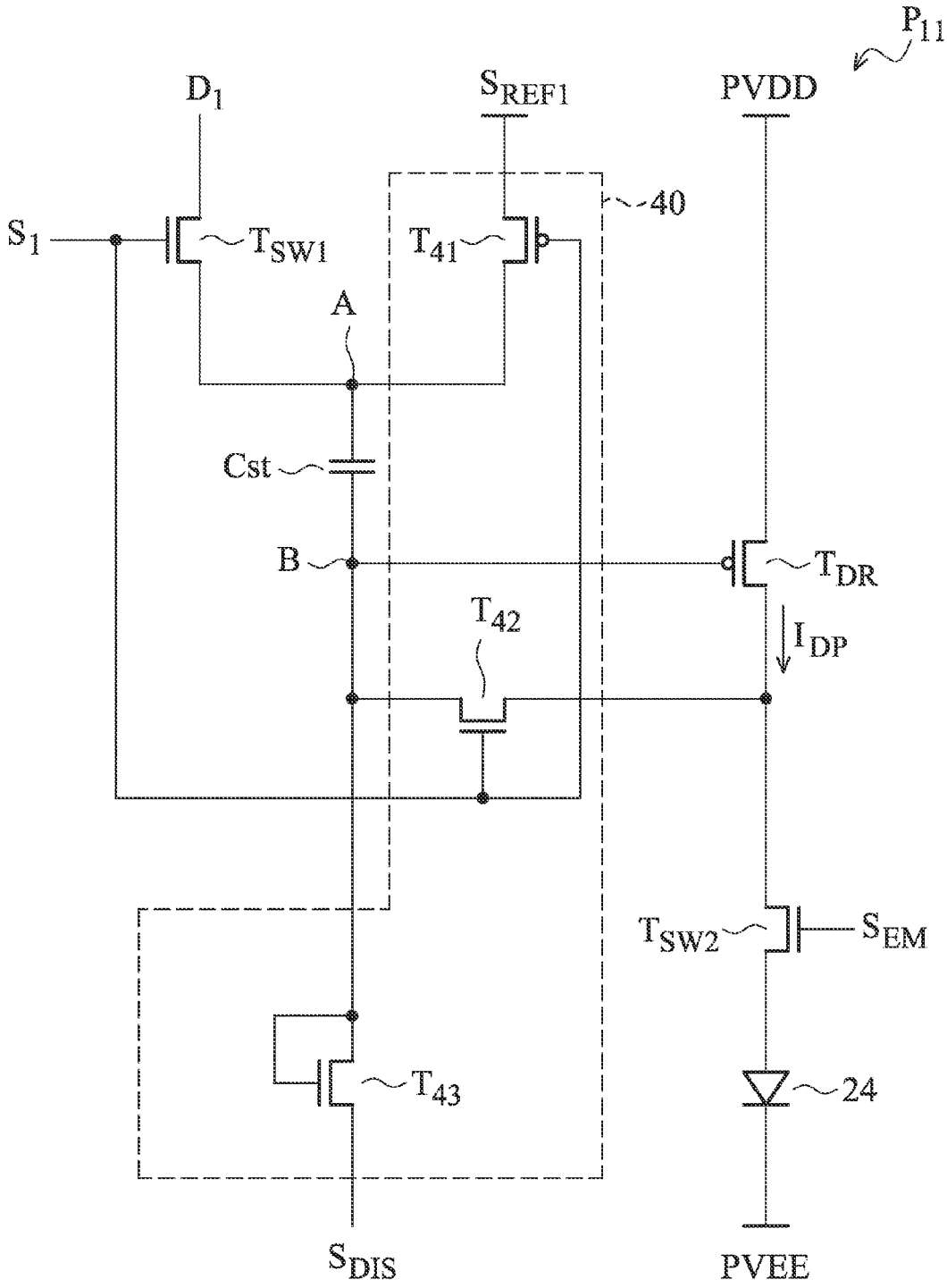

FIG. 4 is a schematic diagram of another exemplary embodiment of the pixel structure. FIG. 4 is similar to FIG. 2A with the exception that the setting transistor $T_{43}$ is an N-type transistor. Since the connection between the setting transistors $T_{41}$ and $T_{42}$ is the same as the connection between the setting transistors $T_{21}$ and $T_{22}$, description is omitted for brevity.

In this embodiment, the setting transistor $T_{43}$ is a diode connection. The setting transistor $T_{43}$ comprises a gate coupled to the node B, a drain receiving the discharging signal $S_{DIS}$ and a source coupled to the node B. When the discharging signal $S_{DIS}$ and the voltage level of the node B are sufficient to turn on the setting transistor $T_{43}$, the voltage level of the node B is equal to the sum of the operation voltage PVEE and the threshold voltage of the setting transistor $T_{43}$. In one embodiment, the discharging signal $S_{DIS}$ is equal to the operation voltage PVEE.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pixel structure, comprising:

a first switching transistor transmitting a data signal to a first node according to a scan signal;

a setting unit controlling the voltage level of the first node and the voltage level of a second node according to the scan signal and a discharging signal;

a capacitor coupled between the first and the second nodes;

a driving transistor comprising a first threshold voltage and a gate coupled to the second node;

a second switching transistor comprising a gate receiving an emitting signal; and a luminous element coupled to the driving transistor and the second switching transistor in series between a first operation voltage and a second operation voltage, wherein during a first period, the setting unit controls the voltage level of the first node to equal a first reference voltage and controls the voltage level of the second node to equal a second reference voltage, and the first reference voltage exceeds the second reference voltage, wherein during a second period, the first switching transistor transmits the first signal to the first node, and the setting unit controls the voltage level of the second node to equal a difference between the first operation voltage and the first threshold voltage, and wherein during a third period, the setting unit controls the voltage level of the first node to equal the first reference voltage and floats the second node.

2. The pixel structure as claimed in claim 1, wherein a difference between the first and the second reference voltages exceeds the first threshold voltage.

3. The pixel structure as claimed in claim 1, wherein the first reference voltage is a positive value and the second reference voltage is an negative value.

4. The pixel structure as claimed in claim 1, wherein the setting unit comprises:

a first setting transistor transmitting the first reference voltage to the first node according to the scan signal;

a second setting transistor making the gate of the driving transistor connected to the drain of the driving transistor; and a third setting transistor transmitting the second reference voltage to the second node according to the discharging signal, wherein the second reference voltage is equal to the second operation voltage.

5. The pixel structure as claimed in claim 4, wherein the third setting transistor is a N-type transistor comprising a gate receiving the discharging signal, a drain receiving the second operation voltage and a source coupled to the second node.

6. The pixel structure as claimed in claim 1, wherein the setting unit comprises:

a first setting transistor transmitting the first reference voltage to the first node according to the scan signal;

a second setting transistor making the gate of the driving transistor connected to the drain of the driving transistor; and a third setting transistor comprising a second threshold voltage, wherein during the second period, the third setting transistor controls the second reference voltage to equal the sum of the second operation voltage and the second threshold voltage.

7. The pixel structure as claimed in claim 6, wherein the third setting transistor is a P-type transistor comprising a gate receiving the discharging signal, a source coupled to the gate of the P-type transistor and a drain coupled to the second node.

8. The pixel structure as claimed in claim 7, wherein the discharging signal is equal to the second operation voltage.

9. The pixel structure as claimed in claim 6, wherein the third setting transistor is an N-type transistor comprising a gate, a source coupled to the gate of the N-type transistor and a drain receiving the discharging signal.

10. The pixel structure as claimed in claim 9, wherein the discharging signal is equal to the second operation voltage.

11. A display system comprising:

a pixel structure as claimed in claim 1; and a driving module providing the scan signal, the data signal, the first and the second reference voltages, the discharging signal, the emitting signal and the first and the second operation voltages.

* * * * *